US007438607B2

(12) United States Patent
Fong

(10) Patent No.: US 7,438,607 B2
(45) Date of Patent: Oct. 21, 2008

(54) PEDESTAL CONNECTOR MOUNTING HOLES

(75) Inventor: Robert Fong, Bethlehem, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/651,843

(22) Filed: Jan. 10, 2007

(65) Prior Publication Data

US 2008/0166929 A1 Jul. 10, 2008

(51) Int. Cl.
*H01R 4/36* (2006.01)

(52) U.S. Cl. ..... 439/810; 439/798

(58) Field of Classification Search ..... 439/814, 439/810–813, 798, 793
See application file for complete search history.

(56) References Cited

U.S. PATENT DOCUMENTS 4,456,326 A * 6/1984 Sauber ..... 439/540.1
5,117,211 A * 5/1992 Morgan et al. ..... 335/202
5,190,485 A * 3/1993 Ransdell ..... 439/798
5,931,708 A * 8/1999 Annas et al. ..... 439/798
5,957,733 A * 9/1999 Mello et al. ..... 439/814
6,939,183 B2 * 9/2005 Ferretti et al. ..... 439/798
7,056,163 B2 * 6/2006 Hay ..... 439/810
2005/0202732 A1 * 9/2005 Rizzo et al. ..... 439/810

* cited by examiner

*Primary Examiner*—Hien Vu
(74) *Attorney, Agent, or Firm*—Hoffman & Baron, LLP

(57) ABSTRACT

The present invention relates to a new and improved connector bar and techniques for making the same. The connector bar includes a metal body having side-by-side conductor ports, transverse threaded pedestal mount apertures, and set screw openings. The transverse threaded pedestal mount apertures extend completely through the body of the connector bar and are adapted for attachment to a pedestal box. The set screw openings are adapted to each receive a set screw for securing a conductor in one of the conductor ports. Preferably, the transverse threaded pedestal mount apertures and set screw openings are formed from the same side of the connector bar.

6 Claims, 3 Drawing Sheets

PEDESTAL CONNECTOR MOUNTING HOLES

FIELD OF THE INVENTION

The present invention generally relates to an electrical connector, and more particularly to an electrical connector having mounting holes for attachment to a pedestal box and a process for fabricating the same.

BACKGROUND OF THE INVENTION

Power distribution pedestal boxes are typically installed in residential communities. The main power cables are run from one pedestal box to another, with the power cables terminating in connector bars located in each box. Generally, connector bars are rectangular blocks of metal having openings for main power lines, and a plurality of additional openings that are used to distribute power to residences or to other utilities through conductors. Set screws are provided to secure the conductors mechanically and electrically in the connector bar.

Forming a pedestal connector typically requires positioning the metal body in a first position and drilling one or more additional passages for the conductors. The metal body is then repositioned to a second position so that one or more set screw holes are drilled. Once the set screw holes are drilled, the metal body is again repositioned to a third position so that pedestal mount apertures are drilled for attachment to the pedestal. Typically, the forming of the passages, set screw holes and pedestal mount apertures are done in a vertical direction on the metal body with no drilling or threading from opposite or adjacent sides. As a result, the additional steps of repositioning the metal body for proper formation of the passages, set screw holes and pedestal mount apertures are very labor intensive and time consuming.

Therefore, there exists a need to provide an electrical connector for attachment to a pedestal box having passages, set screw holes, and pedestal mount apertures that is made from a less labor intensive and time consuming process. Furthermore, it would be desirable to provide an improved technique for fabricating the electrical connector that minimizes body positioning for proper tooling.

SUMMARY OF THE INVENTION

The present invention relates to a new and improved connector bar and techniques for making the same. The connector bar includes a metal body having side-by-side conductor ports, transverse threaded pedestal mount apertures, and set screw openings. The transverse threaded pedestal mount apertures extend completely through the body of the connector bar and are adapted for attachment to a pedestal box. The set screw openings are adapted to each receive a set screw for securing a conductor in one of the conductor ports. Preferably, the transverse threaded pedestal mount apertures and set screw openings are formed from the same side of the connector bar.

Various aspects of the invention relate to the formation of the electrical connector bar. For example, according to one aspect, a method of fabricating an electrical connector bar includes forming a set screw opening and pedestal mount aperture on a first side of a body member, the set screw opening extending from the first side partially through the body member and the mount aperture extending from the first side completely through the body member to a second side. The method also includes forming from at least a third side of the body member a conductor port, the conductor port extending completely through the body to a fourth side and sized to receive a conductor.

In one preferred embodiment, the method includes drilling the set screw opening and the pedestal mount aperture on the first side of the body member. In another preferred embodiment, the method includes drilling the set screw opening and pedestal mount aperture vertically from a top surface of the body member.

In another preferred embodiment of the present invention, the method includes drilling the pedestal mount aperture and set screw opening vertically, repositioning the connector bar at an approximately ninety degree angle relative to a longitudinal axis of the body member, and drilling the conductor port vertically.

In yet another preferred embodiment, the method includes drilling the pedestal mount aperture and set screw opening vertically, and drilling the side-by-side conductor port horizontally. In yet another preferred embodiment, the method includes attaching the connector box to a pedestal box.

In yet another aspect of the present invention, an electrical connector bar for use in electrical power transmission includes a body member formed from a generally rectangular volume of metal, said body member including a top surface having a plurality of set screw openings adapted to receive a set screw to secure a conductor, a plurality of pedestal mount apertures extending from the top surface completely through the body member to a bottom surface of the body member, the pedestal mount apertures adapted to receive a screw to secure the body member to a pedestal box; and a conductor port extending from opposing sides of the body member, the conductor port sized to receive the conductor, wherein, upon insertion of said conductor into the conductor port and rotation of the set screw, the conductor is secured to said body member.

Additional features and advantages will be readily apparent from the following detailed description, the accompanying drawings and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
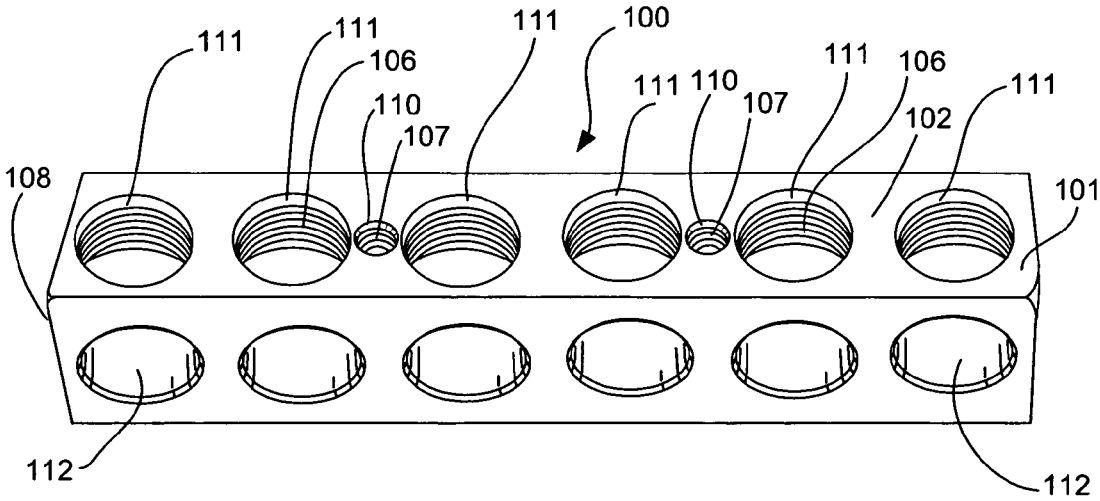
FIG. 1 is a perspective view of a connector bar in accordance with the present invention.
Figure 2:
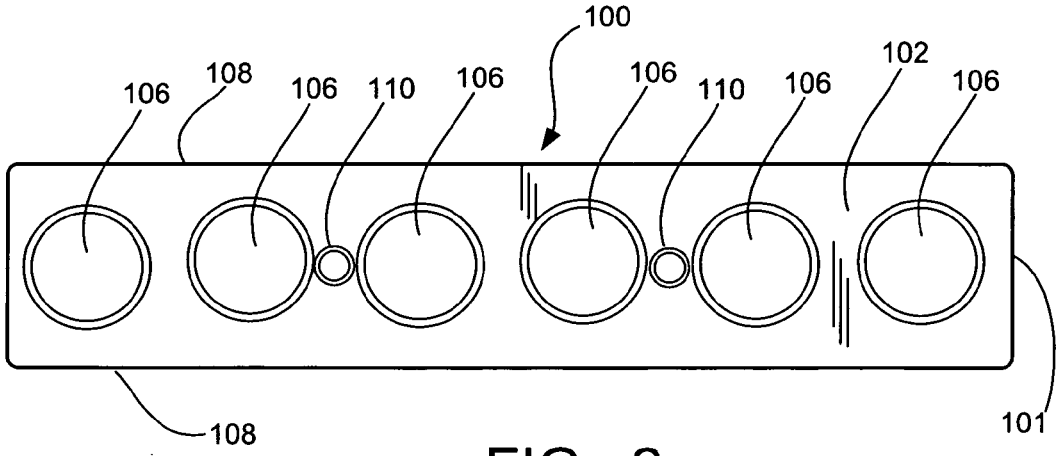
FIG. 2 is a top view of the connector bar shown in FIG. 1.
Figure 3:
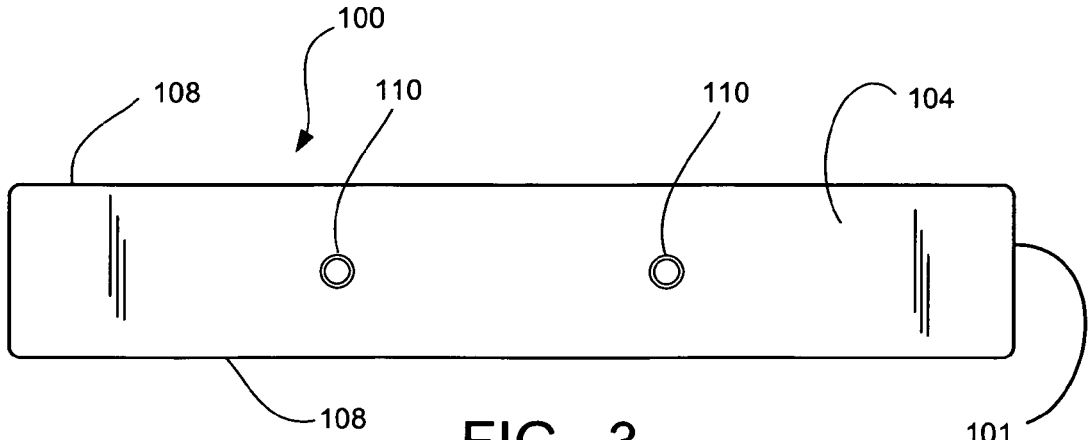
FIG. 3 is a bottom view of the connector bar shown in FIG. 1.
Figure 4:
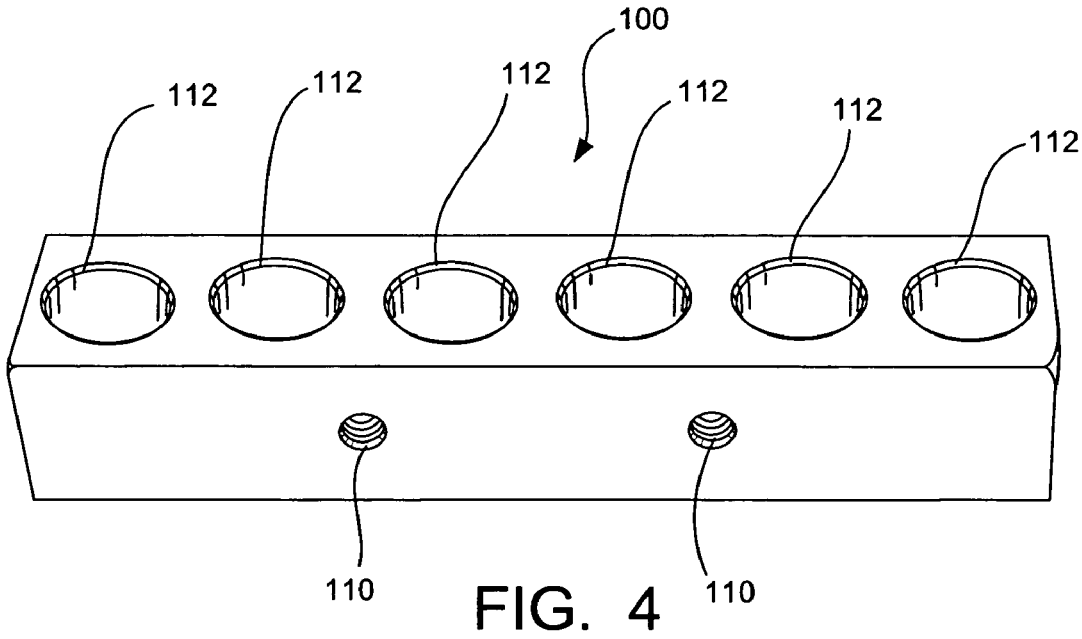
FIG. 4 is another perspective view of the connector bar shown in FIG. 1.

Referring now to FIGS. 1-7, an electrical connector bar 100 for use in electrical power transmission according to the present invention is disclosed. As shown in FIG. 1, the electrical connector bar 100 includes a body member 101 formed from a generally rectangular volume of metal, such as aluminum or steel, having high electrical conductivity.

In one preferred embodiment, as shown in FIGS. 1-4, the connector bar 100 includes a top surface 102, a bottom surface 104, and side surfaces 108. The top surface 102 of the connector 100 includes a plurality of set screw openings 106 that are formed to secure a conductor to the connector 100. The top surface 102 of the connector 100 also includes a plurality of pedestal mount apertures 110 extending from the top surface 102 completely through the body member 101 to a bottom surface 104 of the body member 101. As shown in the figures, preferably each of pedestal mount apertures 110 and set screw openings 106 are threaded 107, 111, respectively, and are adapted to each receive a screw for securing the connector 100 to a pedestal box.

Preferably, the connector bar 100 of the present invention includes a plurality of conductor ports 112 that extend from opposing sides 108 of the body member 101. In one preferred embodiment, the conductor ports 112 are sized to receive a conductor and extend completely through the connector body 101 from one side to another side 108. Preferably, the connector bar 100 is formed such that each of the set screw openings 106 intersects each of the conductor ports 112. In one preferred embodiment, the set screw openings 112 are axially aligned with the axes of the conductor ports 112 and are tapped with the threads 111 for receiving a set screw to secure a conductor.

Figure 5:
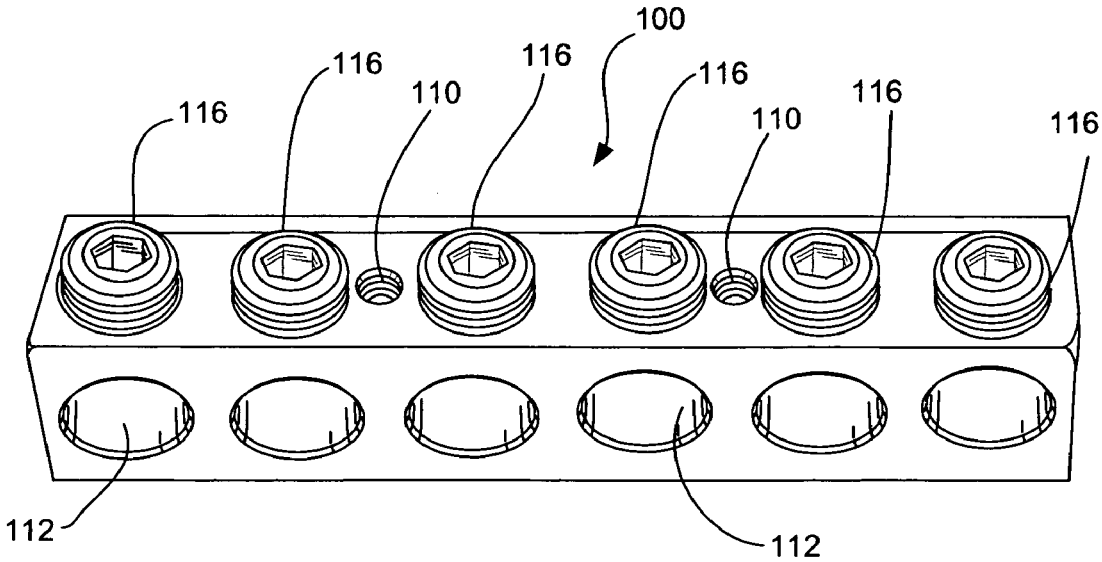
FIG. 5 is another perspective view of the connector bar shown in FIG. 1 with set screws.
Figure 6:
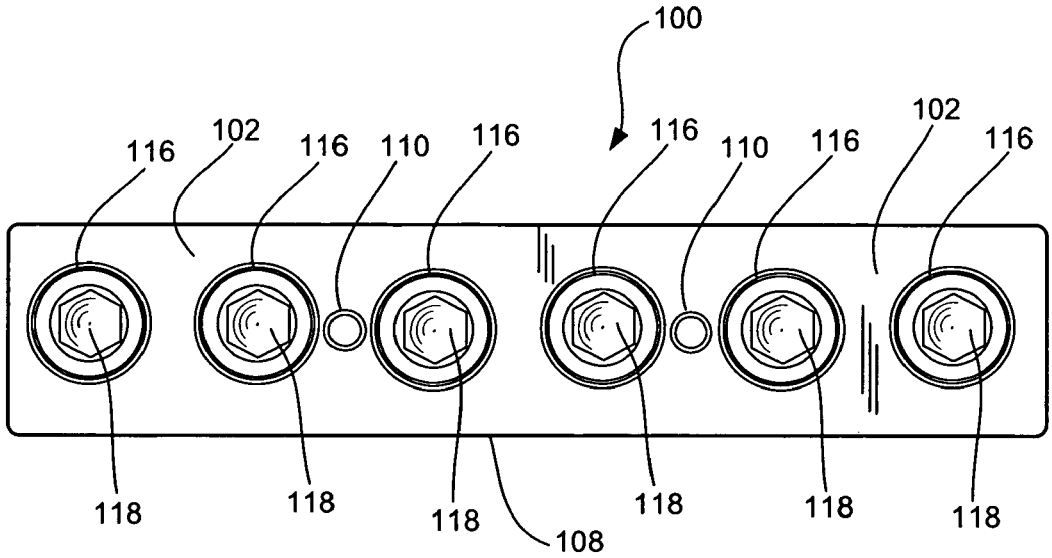
FIG. 6 is a top view of the connector bar shown in FIG. 5.
Figure 7:
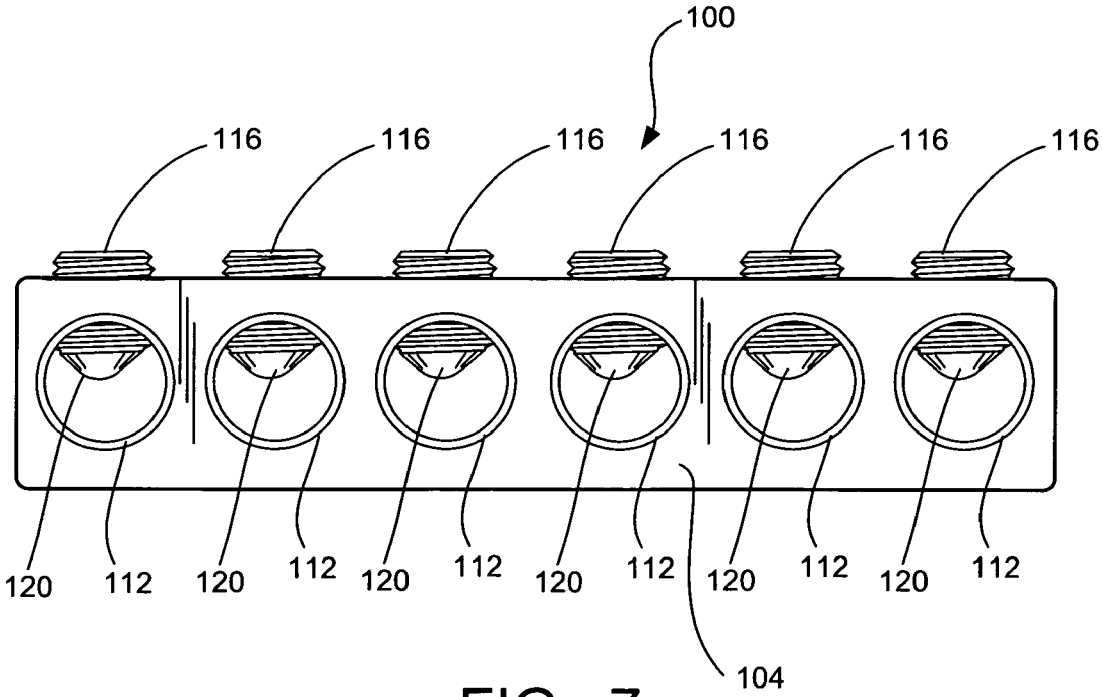
FIG. 7 is a front elevation view of the connector bar shown in FIG. 5.

For example, referring now to FIGS. 5-7, views of the connector bar 100 with set screws according to the present invention is disclosed. Each set screw 116 preferably includes a recessed hexagonal drive head 118 that may be driven for rotation by an allen wench that fits snuggly in the recessed hexagonal head 118. The set screws 116 are preferably made of aluminum or steel, which is the same or similar conductive material from which the body 101 is made. Of course, it will be appreciated by one skilled in the art that the set screws 116 of the present invention may include alternative shaped drive heads that may be driven for rotation by other mechanisms known in the art.

As further shown in FIG. 7, each set screw opening 106 is in communication with a respective conductor port 112. Upon insertion of a conductor into one of the conductor ports 112 and rotation of one of the set screws 116 in communication therewith, a bottom 120 of the set screws 116 extends into the conductor port to mechanically and electrically secure the conductor to the connector 100.

In one preferred embodiment, to form the connector 100 of the present invention, the set screw openings 106 and pedestal mount apertures 110 are drilled vertically from the top surface 102 of the body member 101. Preferably, the set screw openings 106 extend from the top surface 102 and are drilled partially through the body member 101. The pedestal mount apertures 110 are drilled from the top surface 102 completely through the body member 101 to the bottom surface 104. In one preferred embodiment, for example, a first and second tap operation is performed to form the threaded regions 111, 107 of the set screw openings 106 and pedestal mount apertures 110, respectively. Specially cut taps may be utilized to produce a variety of threaded regions supplying the proper thread profile for contact maximization of set screws and the pedestal box.

In one preferred embodiment, only a portion of the pedestal mount apertures 110 are threaded. In this preferred embodiment, a counter-sink (not shown) is drilled through the metal body 101 that is slightly oversized from a desirable thread size. Threading is then performed at the drilled position of the countersink in the body 101 and continues completely through to the opposite side 108 of the body 101.

To form the conductor ports 112, in one preferred embodiment, the metal body 101 is repositioned at approximately ninety (90) degrees along the longitudinal axis of the body 101. Once the bar is repositioned, the conductor ports 112 are drilled vertically from the second position and extend completely through the sides 108 of the body 101. Of course, it will be appreciated by one skilled in the art that the conductor ports 112 may be formed first followed by formation of the set screw openings 1-6 and pedestal mount apertures 110.

In another preferred embodiment, the connector bar 100 is formed by drilling the conductor ports 112 horizontally through the metal body member 101, and drilling and threading the set screw holes 106 and pedestal mount apertures 110 vertically from the top surface 102 of the metal body member 101. In yet another preferred embodiment, the connector 100 is formed by drilling the conductor ports 112 vertically through the body member 101 and drilling and threading the set screw holes 106 and pedestal mount apertures 110 horizontally from the side surfaces 108 of the metal body member 101.

Advantageously, the process of forming the connector bar 100 according to the present invention eliminates the need to reposition the body member 101 an unnecessary number of times. In particular, since both the set screw openings 106 and the pedestal mount apertures 110 are formed from the same side of the body 101, the various disclosed techniques are less labor intensive and time consuming than techniques practiced in the prior art.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A pedestal connector bar for use in electrical power transmission comprising:

a block-shaped body member having a generally rectangular cross section defined by a top surface, a bottom surface, a first side surface and a second side surface, said body member including:

a plurality of set screw openings formed in said top surface and adapted to receive a set screw to secure a conductor, wherein each of said set screw openings is threaded and has an axis;

a plurality of pedestal mount apertures formed in said top surface and extending through said body member to said bottom surface, said pedestal mount apertures are threaded and adapted to receive a screw to secure said body member to a pedestal box; said set screw openings and said pedestal mount apertures are aligned in a row, each of said pedestal mount apertures being positioned in between two adjacent set screw openings and centers of said set screw openings and said pedestal mount apertures are in said row; and one or more conductor ports extending from said first side surface to said second side surface, and wherein each of said conductor ports has an axis, wherein, upon insertion of said conductor into said conductor port and rotation of said set screw, said conductor is secured to said body member wherein said pedestal mount apertures are partially threaded.

2. The pedestal connector bar of claim 1, wherein said body member is formed from a metal.

3. The pedestal connector bar of claim 2, wherein said metal is aluminum or steel.

4. The pedestal connector bar of claim 1, wherein said set screw includes a recessed hexagonal drive head.

5. The pedestal connector bar of claim 4, wherein said set screw is rotatable.

6. The pedestal connector bar of claim 1, wherein said axis of each of said set screw openings intersects said axis of each of said conductor ports.

* * * * *